US006200163B1

(12) United States Patent
O'Sullivan

(10) Patent No.: US 6,200,163 B1
(45) Date of Patent: Mar. 13, 2001

(54) ELECTRICAL CONNECTOR INCLUDING MEANS FOR TERMINATING THE SHIELD OF A HIGH SPEED CABLE

(75) Inventor: Michael O'Sullivan, Willowbrook, IL (US)

(73) Assignee: Molex Incorporated, Lsile, IL (US)

( * ) Notice: Subject to any disclaimer, the term of this patent is extended or adjusted under 35 U.S.C. 154(b) by 0 days.

(21) Appl. No.: 09/386,105

(22) Filed: Aug. 30, 1999

(51) Int. Cl.[7] ..... H01R 9/05
(52) U.S. Cl. ..... 439/579; 439/907
(58) Field of Search ..... 439/101, 497, 439/579, 610, 907

(56) References Cited

U.S. PATENT DOCUMENTS

| | | | |
|---|---|---|---|
| 4,842,544 | 6/1989 | Birch et al. | 439/387 |
| 5,256,084 | 10/1993 | Kodama | 439/595 |
| 5,647,764 | 7/1997 | Kimura | 439/595 |
| 5,660,551 | 8/1997 | Sakurai | 439/108 |
| 5,711,686 | 1/1998 | O'Sillivan et al. | 439/610 |
| 5,716,236 | 2/1998 | O'Sullivan et al. | 439/610 |
| 5,725,387 | 3/1998 | O'Sullivan et al. | 439/98 |

FOREIGN PATENT DOCUMENTS

| | | |
|---|---|---|
| 0 740 367 A1 | 10/1996 | (EP) . |
| 3-1463 | 1/1991 | (JP) . |

*Primary Examiner*—Neil Abrams
*Assistant Examiner*—Javaid Nasri
(74) *Attorney, Agent, or Firm*—Robert J. Zeitler

(57) ABSTRACT

An electrical connector includes a dielectric housing and a plurality of terminals mounted therein. A conductive ground blade is mounted in the housing and includes at least a pair of positioning arms projecting therefrom for engaging the metallic shields of a pair of coaxial cables. A partition on the housing extends between the positioning arms to separate the coaxial cables and maintain the metallic shields near the positioning arms.

19 Claims, 9 Drawing Sheets

ELECTRICAL CONNECTOR INCLUDING MEANS FOR TERMINATING THE SHIELD OF A HIGH SPEED CABLE

FIELD OF THE INVENTION

This invention generally relates to the art of electrical connectors and, particularly, to a connector for a plurality of coaxial cables and including a system for terminating the metallic shields of high speed cables, such as the metallic braids of the cables.

BACKGROUND OF THE INVENTION

A typical high speed cable includes a center conductor or core surrounded by a tube-like inner dielectric. A shield is disposed outside the inner dielectric for shielding and/or grounding the cable. The shield typically is a tubular metallic braid. However, one or more longitudinal conductive wires have also been used and are commonly called "drain wires." An insulating jacket surrounds the composite cable outside the shield.

Various types of connectors are used to terminate high speed cables. The connectors typically have contacts which are terminated to the center conductor or core of the cable. The connectors also have one form or another of a terminating member for terminating the metallic shield of the high speed cable, usually for grounding purposes. A typical system in such connectors terminates the metallic shield to the terminating member by soldering or welding. Other systems use crimping procedures to crimp at least a portion of the terminating member securely to the metallic braid.

With the ever-increasing miniaturization of the electronics in various industries, such as in the computer and telecommunications industries, along with the accompanying miniaturization of electrical connectors, considerable problems have been encountered in terminating miniature high speed cables, particularly in terminating the metallic shield of the cable. For instance, the outside diameter of a small coaxial cable may be on the order of 0.090 inch. The outside diameter of the inner dielectric surrounding the conductor/core may be on the order of 0.051 inch, and the diameter of the center conductor/core may be on the order of 0.012 inch. Coaxial cables having even smaller dimensional parameters have been used.

The problems in terminating small coaxial cables often revolve around terminating the metallic shield of the cable. For instance, if soldering methods are used, applying heat (necessary for soldering) in direct proximity to the metallic shield can cause heat damages to the underlying inner dielectric and, in fact, substantially disintegrate or degrade the inner dielectric. If conventional crimp-type terminations are used, typical crimping forces often will crush or deform the inner dielectric surrounding the center conductor/core of the cable. In either case, damage or deformation of the inner dielectric will change the electrical characteristics of the cable.

The above problems are further complicated when the metallic shield of the high speed cable is not terminated to a cylindrical terminating member, but the shield is terminated to a flat terminating member or contact. For instance, an example of terminating the metallic shield or braid of a coaxial cable to a flat ground member is shown in U.S. Pat. No. 5,304,069, dated Apr. 19, 1994 and assigned to the assignee of the present invention. In that patent, the metallic braids of a plurality of coaxial cables are terminated to a ground plate of a high speed signal transmission terminal module. The conductors/cores of the coaxial cables are terminated to signal terminals of the module. Other examples are shown in U.S. Pat. Nos. 5,711,686, dated Jan. 27, 1998; 5,716,236, dated Feb. 10, 1998; 5,718,607, dated Feb. 17, 1998; 5,725,387, dated Mar. 10, 1998; and 5,785,555, dated Jul. 28, 1998, all of which are assigned to the assignee of the present invention.

The present invention is directed to further improvements in managing the termination of high speed coaxial cables, including the termination of the metallic shields of a plurality of cables to a terminating member, such as a ground blade.

SUMMARY OF THE INVENTION

An object, therefore, of the invention is to provide a new and improved electrical connector which includes a system for terminating the metallic shields of high speed cables.

In the exemplary embodiment of the invention, the connector includes a dielectric housing having a front mating face and a rear terminating face, a plurality of terminal-receiving passages extending generally between the faces, and a blade-receiving passage extending generally between the faces . A plurality of terminals are received in the terminal-receiving passages. A conductive ground blade is received in the blade-receiving passage. The ground blade includes at least a pair of positioning arms projecting from the ground blade at the rear terminating face of the housing for engaging the metallic shields of a pair of coaxial cables. A partition on the housing extends between the positioning arms to separate the coaxial cables and maintain the metallic shields near the positioning arms.

As disclosed herein, the housing is molded of dielectric plastic material, and the partition is molded integrally therewith. The housing includes an abutment shoulder for engaging an abutment shoulder on the ground blade to prevent the blade from backing out of the blade-receiving passage. The ground blade is generally planar and includes a slot, and the partition comprises a wall projecting through the slot and between the positioning arms.

According to one aspect of the invention, a pair of the positioning arms project from each opposite side of the ground blade. A partition on the housing extends between each pair of arms to define four quadrants for accommodating four coaxial cables. Four of the terminal-receiving passages are provided in the housing aligned with the four quadrants for receiving four signal terminals. The four terminals have tail portions for connection to inner conductors of the four coaxial cables.

According to another aspect of the invention, the housing includes a front housing part having the passages therein for mounting the terminals and the ground blade. A rear housing part is juxtaposed against the front housing part and includes the partition. Complementary interengaging abutment means are provided between the rear housing part and the ground blade to prevent the ground blade from backing out of the blade-receiving passage in the front housing part.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
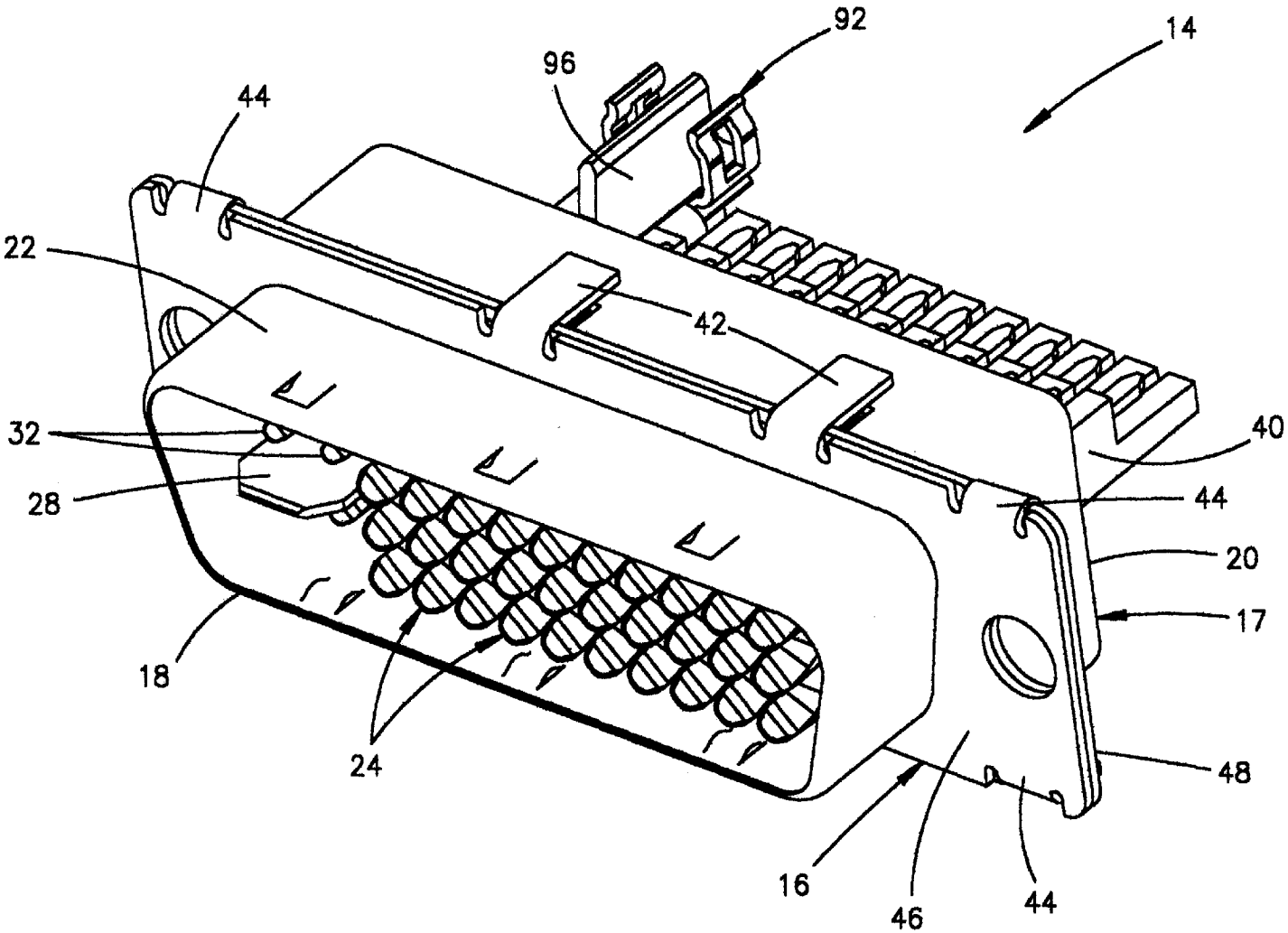
FIG. 1 is a perspective view of an electrical connector embodying the concepts of the invention.
Figure 2:
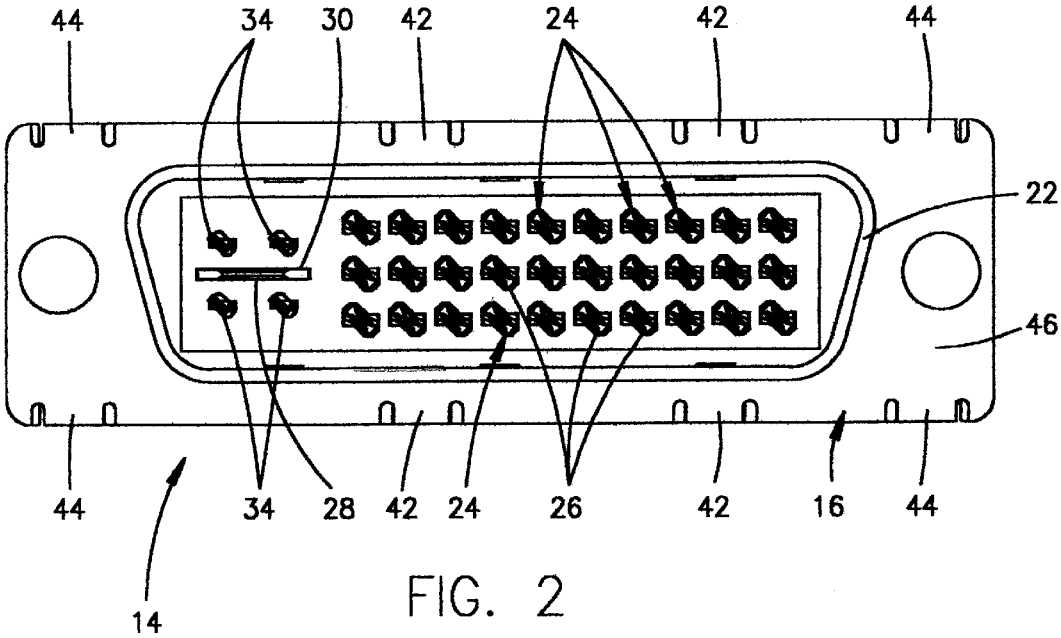
FIG. 2 is a front elevational view of the connector.

Referring to the drawings in greater detail, and first to FIGS. 1–5, the invention is embodied in an electrical connector, generally designated 14, which includes an inner dielectric housing (described hereinafter) substantially surrounded by a front shield, generally designated 16, and a back shield, generally designated 17. Each shield 16 and 17 is a one-piece structure stamped and formed or drawn of conductive sheet metal material.

The connector is an input/output (I/O) electrical device wherein front shield 16 defines a front mating face 18 of the connector, and rear shield 17 defines a rear terminating face 20. The front face actually is formed by a shroud portion 22 of shield 16 surrounding forwardly projecting contact portions of three rows of data transmission terminals, generally designated 24. The data transmission terminals project through terminal-receiving passages 26 in the connector housing. A conductive ground blade 28 projects through a blade-receiving passage 30 (FIG. 2) in the connector housing. A pair of high speed signal terminals 32 project through a pair of terminal-receiving passages 34 (FIG. 2) in the housing on each opposite side of ground blade 28. Terminating or tail portions 36 and 38 of data transmission terminals 24 and high speed signal terminals 32, respectively, project rearwardly of rear shield 17 on a rear platform 40 of the connector housing.

Front shield 16 has a pair of rearwardly formed tabs 42 on both the top and bottom thereof to embrace the housing as will be seen hereinafter. Four rearwardly formed tabs 44 are bent from a base plate 46 of front shield 16 over a base plate 48 of rear shield 17 to secure the front and rear shields about the connector housing.

Figure 6:
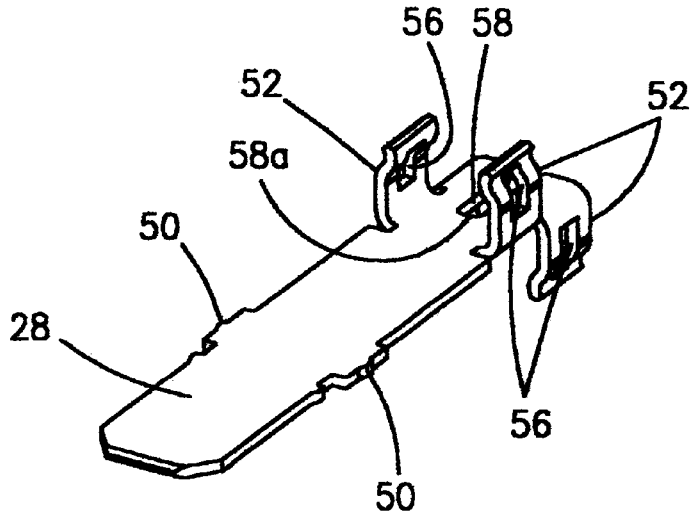
FIG. 6 is a front perspective view of the ground blade of the connector.
Figure 7:
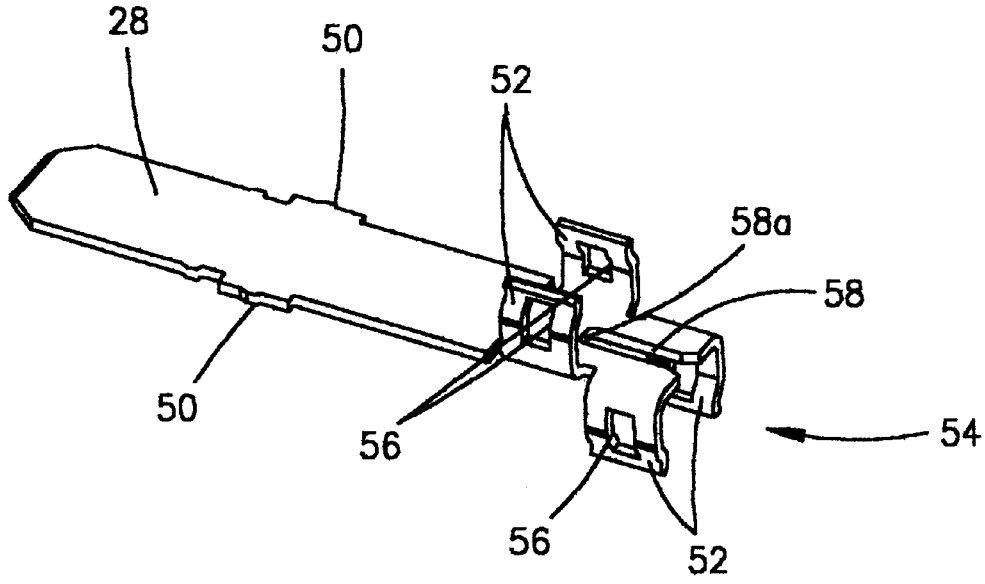
FIG. 7 is a rear perspective view of the ground blade.

Before proceeding with further details of the interior of the connector and the assembly thereof, reference is made to FIGS. 6 and 7 which show details of conductive ground blade 28. The blade is stamped and formed of sheet metal material. As can be seen, the blade is elongated and generally planar to define a long ground plate. Barbs 50 are stamped at opposite edges of the ground blade for establishing an interference fit within blade-receiving passage 30 of the housing. A pair of positioning arms 52 project from each opposite side of the ground blade at a rear terminating end 54 thereof. Each positioning arm includes a stamped window 56. The positioning arms are arcuately shaped for engaging a metallic shield, such as a metallic braid of a coaxial cable. The positioning arms are soldered to the metallic shields, and windows 56 allow for the flow of solder material into engagement with the shield. A slot 58 is formed in ground blade 28. The slot is open at rear end 54 of the blade and has a closed end **58*a*** which defines an abutment shoulder, for purposes described hereinafter.

Referring to FIGS. 8–11, connector 14 includes a two-part dielectric housing, generally designated 60, which is formed of a front housing or housing part, generally designated 62, and a rear housing or housing part, generally designated 64. Front housing part defines a front mating end 66 of the housing, and rear housing part 64 defines a rear end 68 of the housing. The front housing part includes terminal-receiving passages 26 for receiving data transmission terminals 24, terminal-receiving passages 34 for receiving high speed signal terminals 32 and blade-receiving passage 30 for receiving ground blade 28. Tails 36 of data transmission terminals 24 and tails 38 of high speed signal terminals 32 project rearwardly of the front housing part. The rear end of the ground blade, including positioning arms 52, also projects rearwardly of the front housing part. The front housing part has end recesses 70 and top and bottom recesses 72 along with upwardly and downwardly projecting tabs 74.

Figure 8:
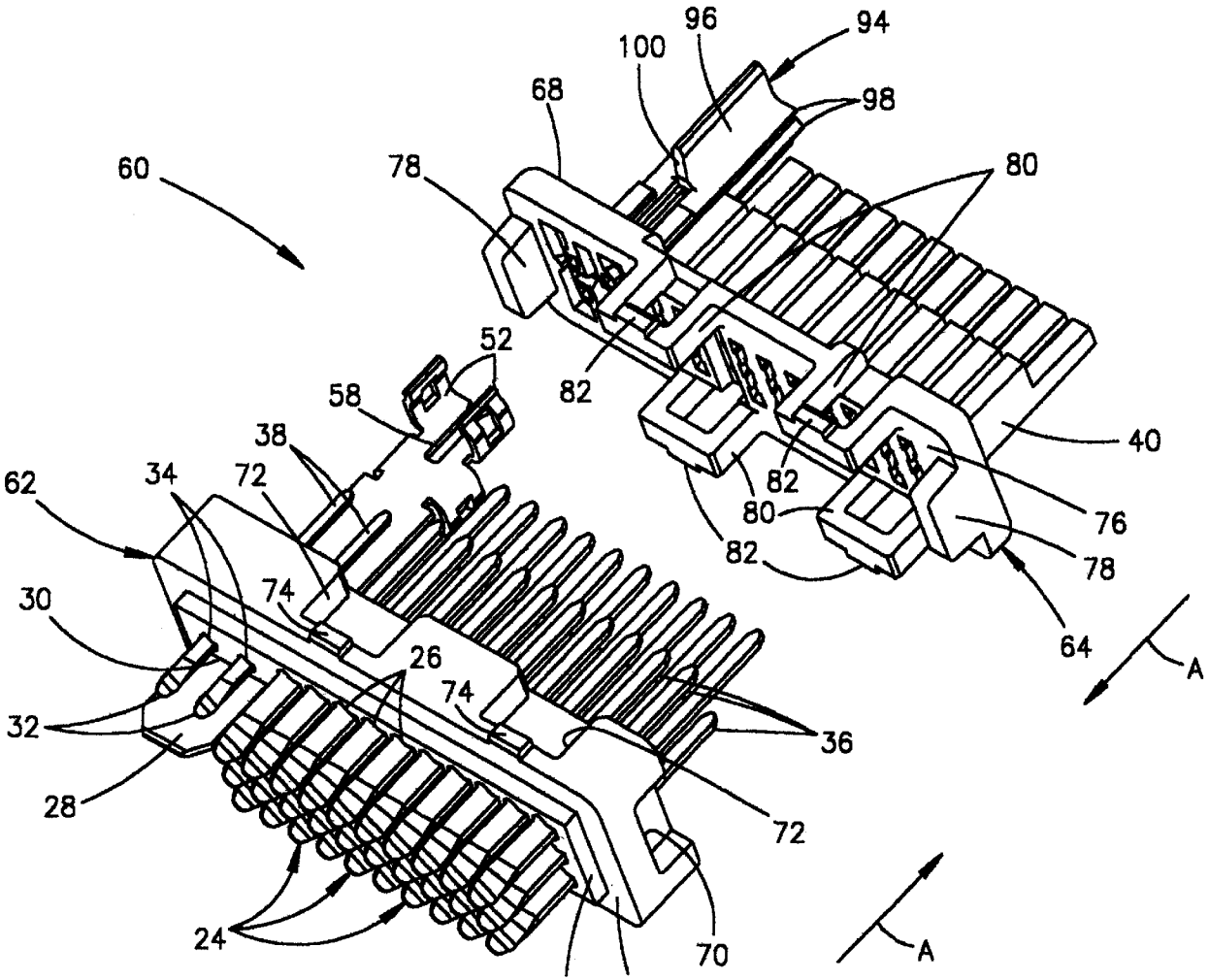
FIG. 8 is an exploded perspective view of the two-part housing with the terminals and ground blade mounted in the front housing part.
Figure 9:
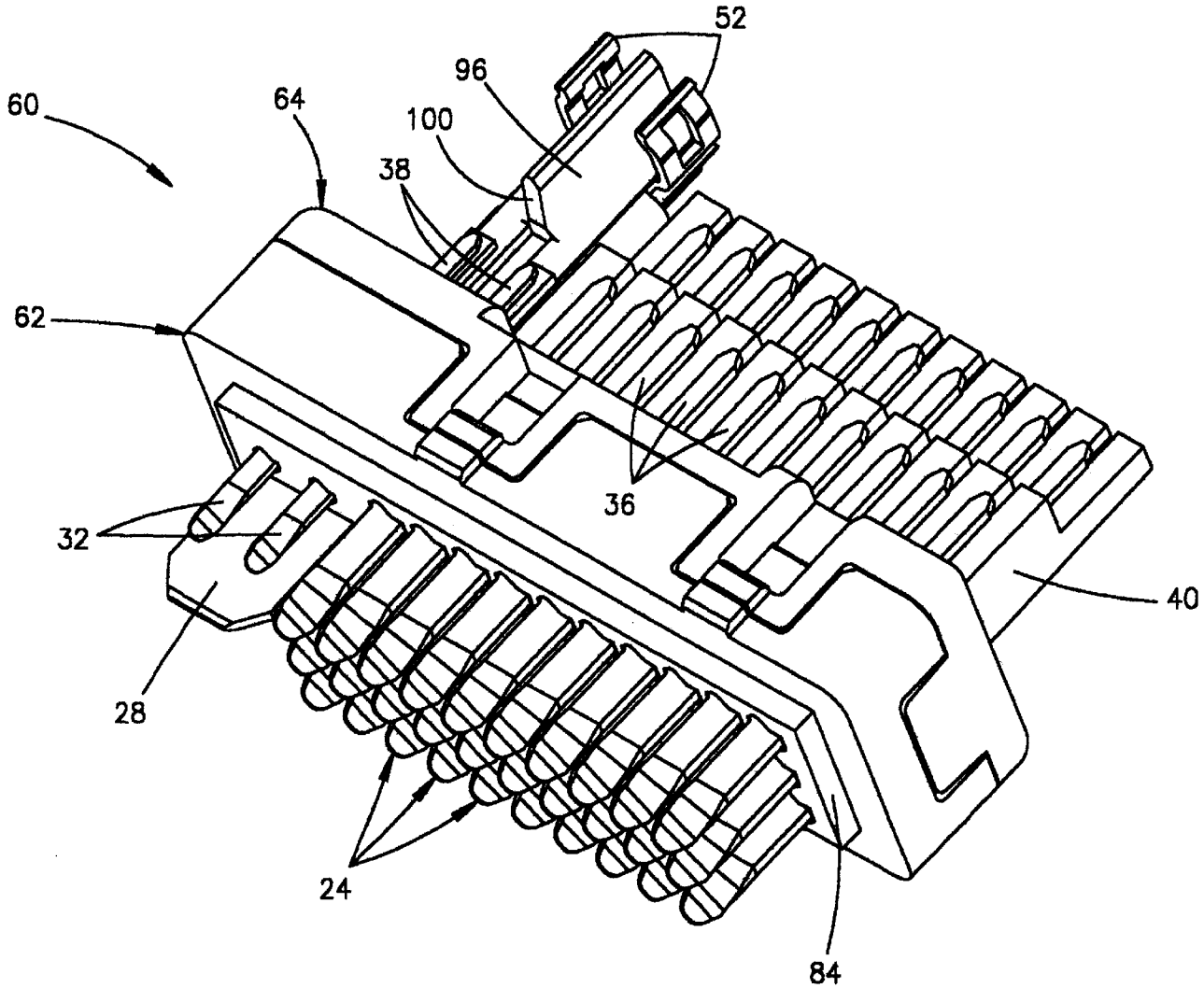
FIG. 9 is a perspective view of the two-part housing in assembled condition.
Figure 10:
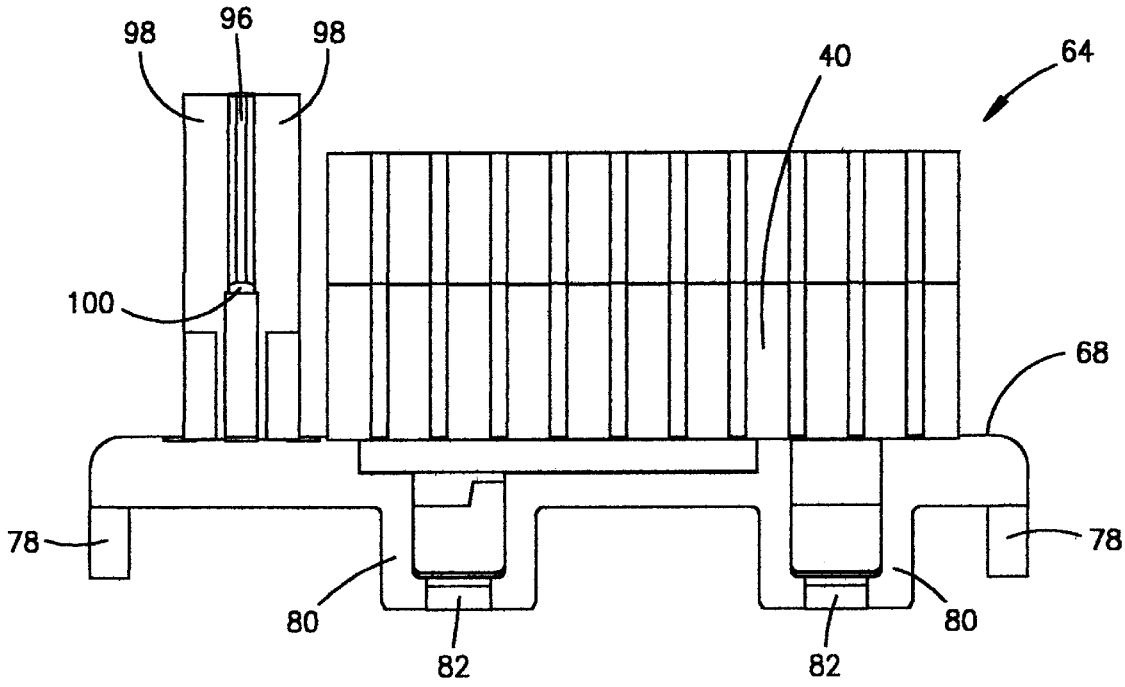
FIG. 10 is a top plan view of the rear housing part.
Figure 11:
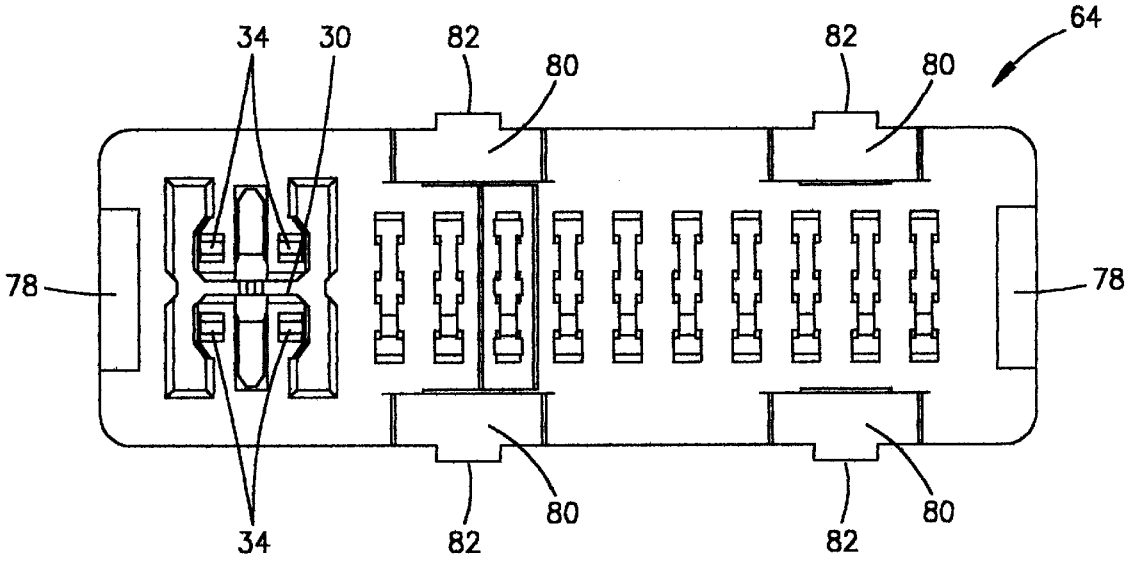
FIG. 11 is a front elevational view of the rear housing part.

Rear housing part 64 includes a main transverse flange 76 for abutting against the rear of front housing part 62 when the housing parts are assembled in the direction of arrows "A" (FIG. 8). The rear housing part has side wings 78 and top and bottom wings 80 which move into recesses 70 and 72, respectively, of the front housing part when the two housing parts are assembled as shown in FIG. 9. Rear housing part 64 also has upwardly and downwardly projecting tabs 82 which become juxtaposed with tabs 74 of the front housing part when assembled as seen in FIG. 9.

Figure 12:
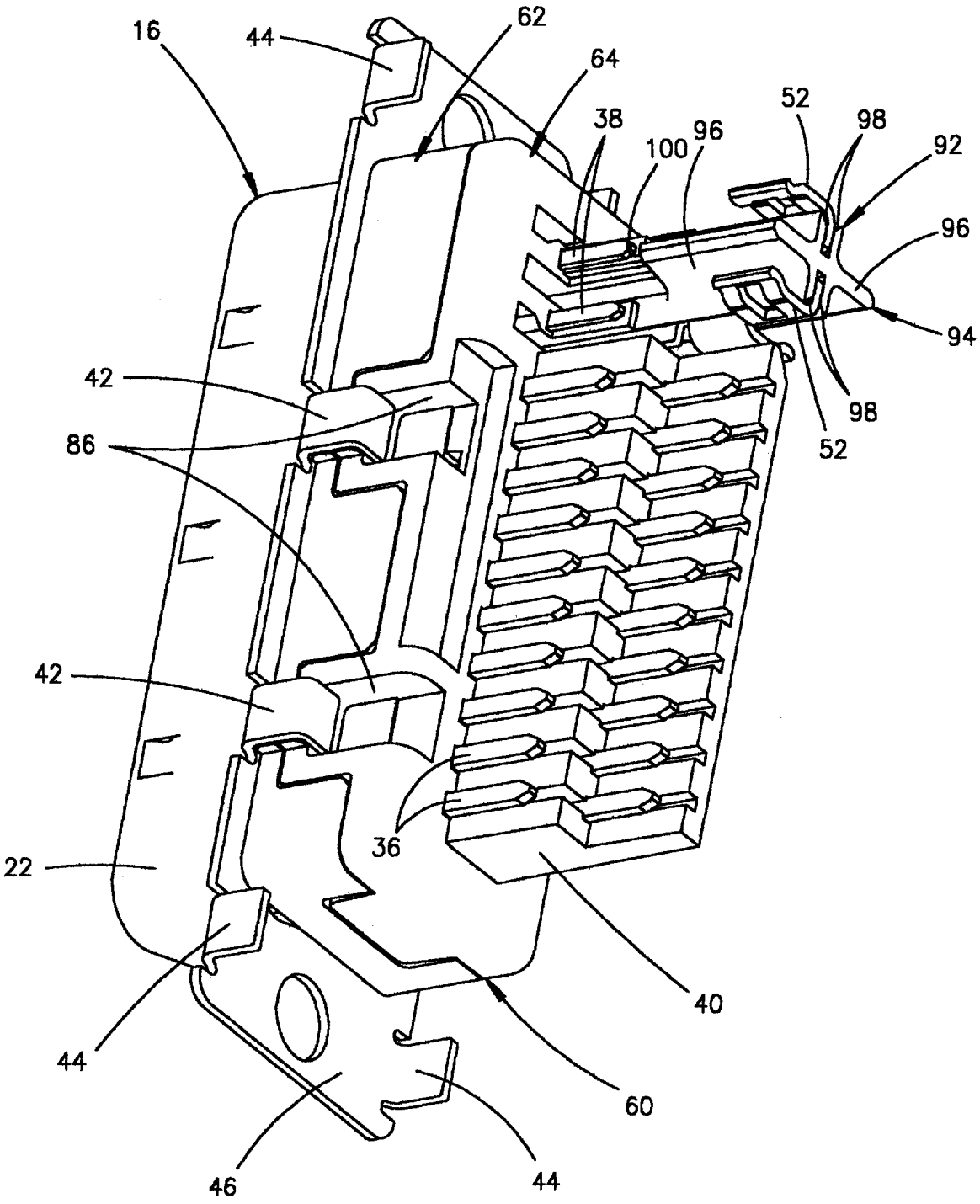
FIG. 12 is a rear perspective view showing the front shield assembled to the two-part housing.

After data transmission terminals 24, high speed signal terminals 32 and ground blade 28 are mounted in front housing part 62, and rear housing part 64 is juxtaposed against the front housing part, the front and rear shields of the connector are assembled to complete the assembly of the connector as shown in FIG. 12. More particularly, as seen in FIG. 12, the subassembly of the two-part housing 60, the data transmission terminals, the high speed signal terminals and the ground blade are assembled to front shield 16 as seen in FIG. 12. An offset portion 84 (FIG. 8) projecting from front end 66 of the front housing part is properly positioned within shroud 22 of the front shield. Tabs 42 at the top and bottom of base plate 46 of the front shield then are bent into recesses 86 in the top and bottom of rear housing part 64, about tabs 74 and 82 (FIGS. 8 and 9) of the front and rear housing parts, respectively. Therefore, tabs 42 of the front shield are effective to not only hold the front shield to housing 60, but to hold the two housing parts 62 and 64 together.

Figure 13:
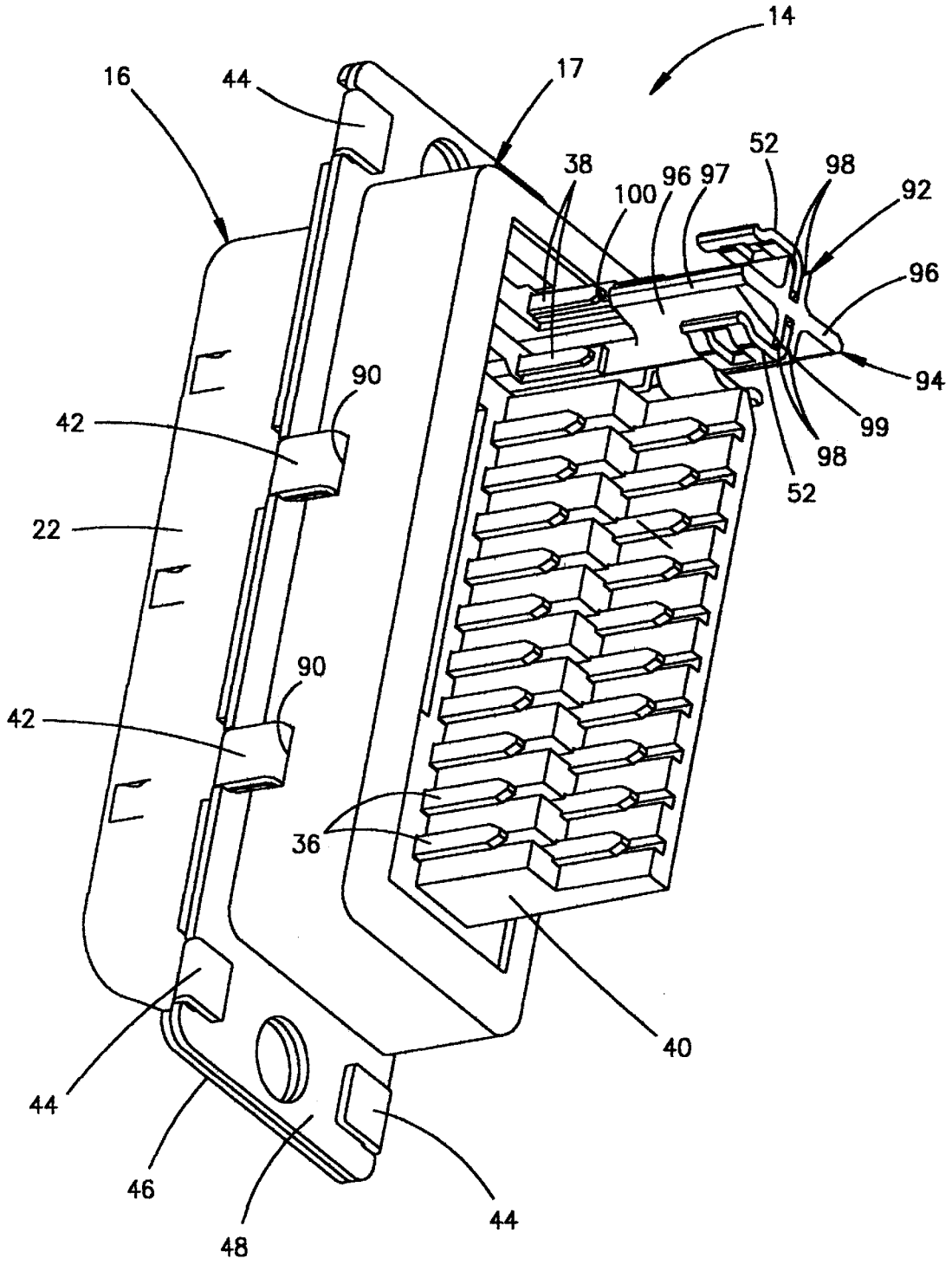
FIG. 13 is a perspective view similar to that of FIG. 12, with the rear shield fully assembled.

Rear shield 17 then is assembled as shown in FIG. 13. The rear shield has a shroud 88 which substantially surrounds the two-part housing, except for rearwardly extending platform 40 of the rear housing. Shroud 88 has apertures 90 for accommodating rearwardly formed tabs 42 of the front shield. In final assembly, tabs 44 of the front shield are bent or formed around the back side of base plate 48 of the rear shield to hold the two shields together and the connector in fully assembled condition.

The invention contemplates a cable management system, generally designated 92 in FIGS. 1, 4, 5, 12 and 13. Basically, the cable management system includes a partition structure, generally designated 94, projecting from the rear of the rear housing part and cooperating with positioning arms 52 of ground blade 28 to properly manage and position prior to termination a plurality (up to four) of coaxial cables, including the termination of the metallic braids of the cables.

Figure 3:
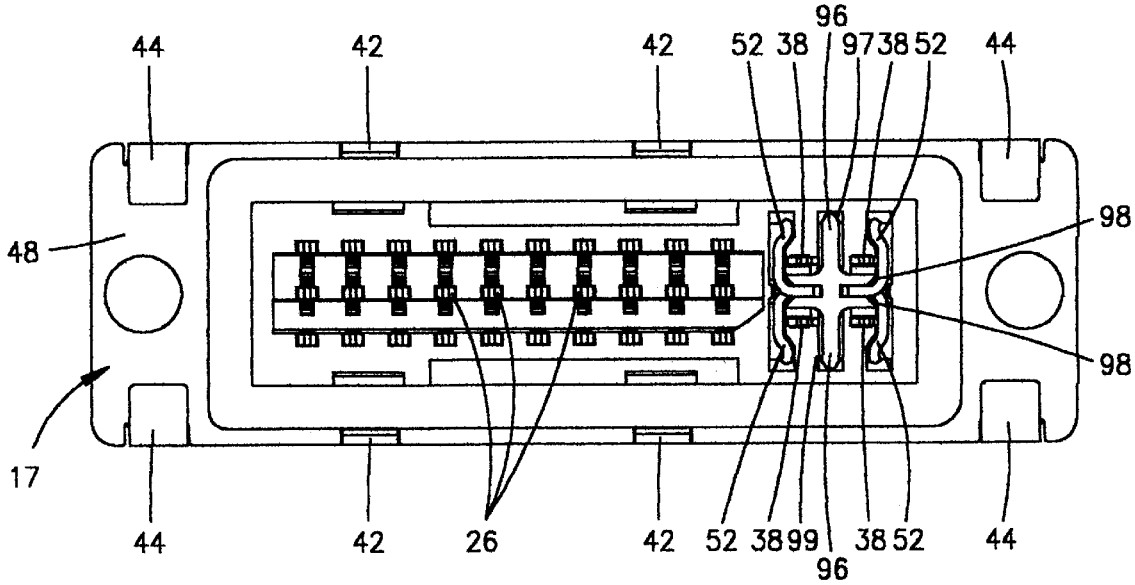
FIG. 3 is a rear elevational view of the connector.
Figure 4:
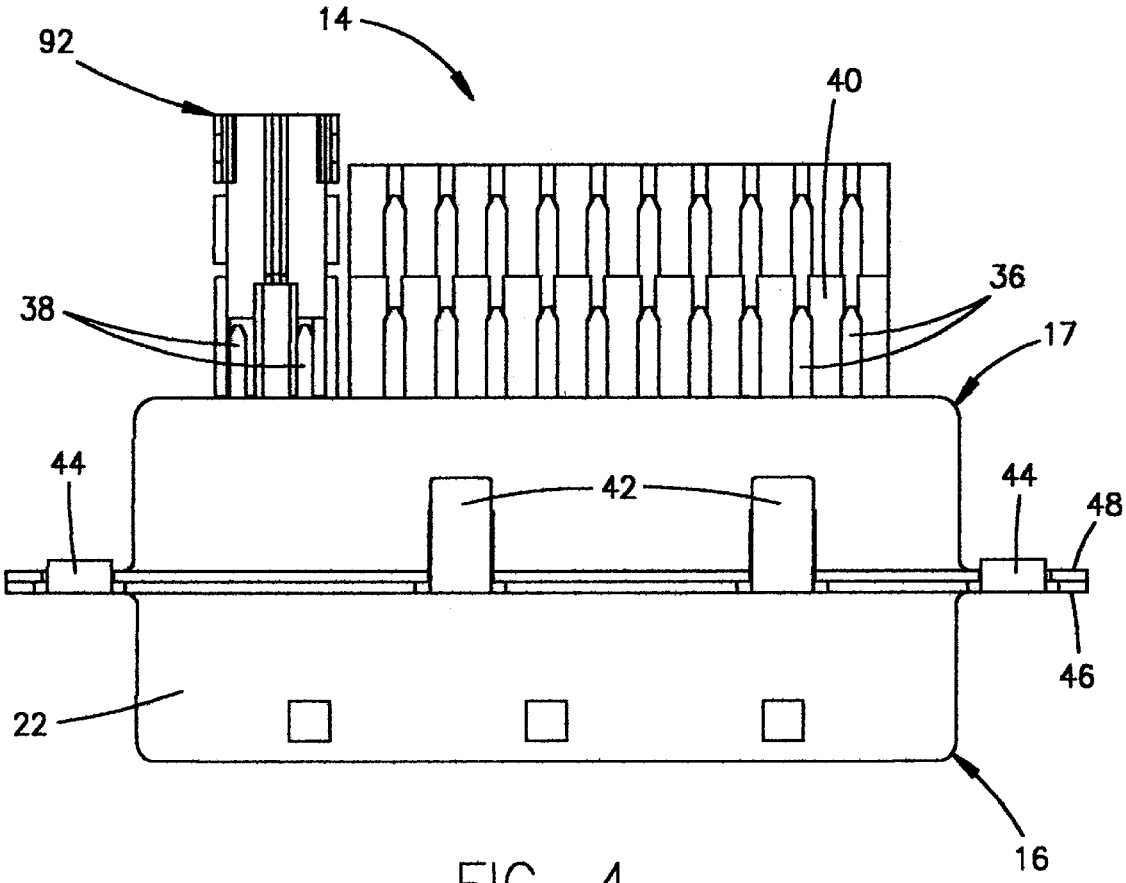
FIG. 4 is a top plan view of the connector.
Figure 5:
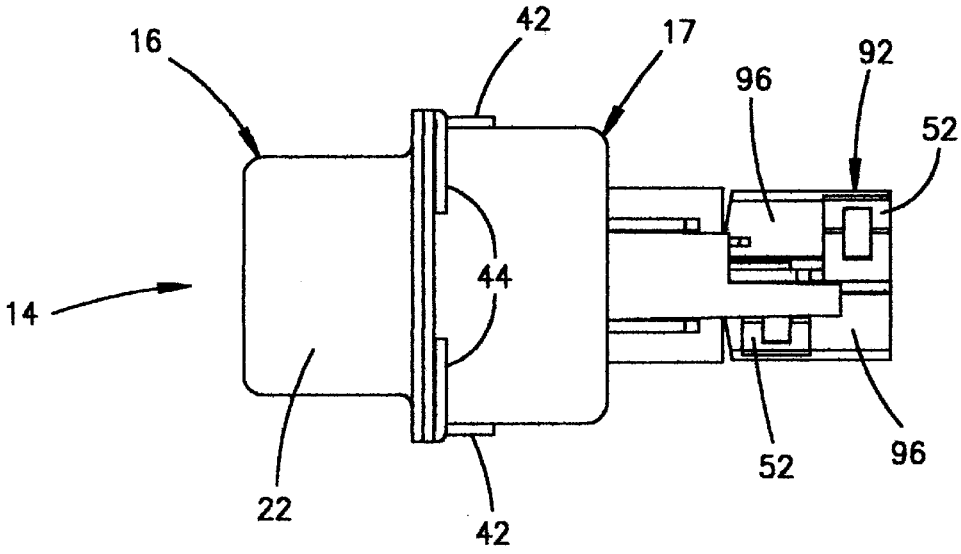
FIG. 5 is a side elevational view of the connector.

More particularly, partition structure 94 includes a pair of oppositely extending partitions or walls 96 which extend between the upper and lower pairs of positioning arms 52 at the rear end of ground blade 28. Partition walls 96 have sloped entry surfaces 97 to guide the cables into position and catches 99 to retain the cables after they have been inserted therein. As such, partitions 96 and positioning arms 52 are effective to divide cable management system 92 into four quadrants for receiving four coaxial cables. FIG. 3 shows tails 38 of high speed signal terminals 32 aligned with the four quadrants defined by partitions 96 and positioning arms 56. FIG. 3 also shows that partition structure 94 has a pair of longitudinal flanges 98 on each opposite side thereof for receiving therebetween the planar portions of the ground blade on opposite sides of slot 58 (FIGS. 6 and 7). A front abutment surface 100 (FIG. 13) of partition structure 94 abuts against the closed end 58*a* (FIGS. 6 and 7) of slot 58 to prevent the ground blade from backing out of its passage in the housing. In other words, after the ground blade is inserted into the rear of front housing part 62 as shown in FIG. 8, assembly of rear housing part 64 to the front housing part causes abutment shoulder 100 of the partition structure to engage abutment end 58*a* of slot 58 in the ground blade, whereby the rear housing part is effective to prevent the ground blade from backing out of the front housing part.

Cable management system 92, including partition structure 94 and positioning arms 52 of ground blade 28, provide a means by which four high speed signal coaxial cables can be terminated to high speed signal terminals 32 and ground blade 28. As is known, each coaxial cable typically has an inner conductor, an inner dielectric surrounding at least a portion of the inner conductor, a metallic shield such as a metallic braid surrounding at least a portion of the inner dielectric and an outer insulating jacket surrounding the metallic shield and by removing a portion of the inner dielectric to expose the inner conductor. The coaxial cables are prepared by removing a portion of the outer jackets thereof to expose portions of the metallic shields and by removing a portion of the inner dielectric to expose the inner conductor. The cables then are positioned in the four quadrants defined by partitions 96 and positioning arms 52. When placed in the quadrants, the coaxial cables are positioned such that the metallic braids are juxtaposed with the positioning arms and can be easily soldered thereto with the windows 56 allowing for the flow of solder material into engagement with the metallic shield. In addition, the inner conductor is aligned such that it is in juxtaposition with the tail portion 38 of signal terminal 32 and can be easily soldered together. Partitions 96 separate each pair of coaxial cables between each pair of positioning arms 52.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector, comprising:

a dielectric housing including a front mating end and a rear terminating end, a plurality of terminal-receiving passages extending generally between said ends, and a blade-receiving passage extending generally between the ends;

a plurality of terminals received in said terminal-receiving passages;

a conductive ground blade received in said blade-receiving passage and including at least a pair of positioning arms projecting from the ground blade at the rear terminating end of the housing for engaging the metallic shields of a pair of coaxial cables; and a partition integral with the housing extending between said positioning arms to separate the coaxial cables and maintain the metallic shields near the positioning arms.

2. The electrical connector of claim 1 wherein said housing includes an abutment shoulder for engaging an abutment shoulder on the ground blade to prevent the blade from backing out of the blade-receiving passage.

3. The electrical connector of claim 1 wherein said ground blade is generally planar and includes a slot, and said partition comprises a wall projecting through the slot and between the positioning arms.

4. The electrical connector of claim 1, including a pair of said positioning arms projecting from each opposite side of the ground blade, with a partition on the housing extending between each pair of arms to define four quadrants.

5. The electrical connector of claim 4, including four of said terminal-receiving passages in the housing aligned with said four quadrants for receiving four signal terminals.

6. The electrical connector of claim 1 wherein said housing includes a front housing part having said passages therein for mounting the terminals and the ground blade, and a rear housing part juxtaposed against the front housing part and including said partition.

7. The electrical connector of claim 6, including complementary interengaging abutment means between the rear housing part and the ground blade to prevent the ground blade from backing out of the blade-receiving passage in the front housing part.

8. The electrical connector of claim 1 wherein said positioning arms include an aperture therein.

9. An electrical connector, comprising:

a housing molded of dielectric material and including a front mating end and a rear terminating end, a plurality of terminal-receiving passages extending generally between said ends, and a blade-receiving passage extending generally between the ends;

a plurality of terminals received in said terminal-receiving passages;

a conductive generally planar ground blade received in said blade-receiving passage and including a pair of positioning arms projecting from each opposite side of the ground blade at a rear terminating end thereof near the rear terminating end of the housing for engaging metallic shields of four coaxial cables, and a slot in the ground blade near said rear terminating end thereof; and a partition integral with the housing and extending between each pair of positioning arms to separate the coaxial cables, maintain the cables in four quadrants with the metallic shields near respective one of the positioning arms, at least one of the partitions extending through the slot in the ground blade, said partition including a wall projecting through the slot and between the positioning arms.

10. The electrical connector of claim 9, including four of said terminal-receiving passages in the housing aligned with said four quadrants for receiving four signal terminals.

11. The electrical connector of claim 9 wherein said housing includes a front housing part having said passages therein for mounting the terminals and the ground blade, and a rear housing part juxtaposed against the front housing part and including said partition.

12. The electrical connector of claim 11, including complementary interengaging abutment means between the rear housing part and the ground blade to prevent the ground blade from backing out of the blade-receiving passage in the front housing part.

13. The electrical connector of claim 9 wherein said positioning arms include an aperture therein.

14. A termination system for terminating at least a pair of coaxial cables each having an inner conductor, an inner dielectric surrounding at least a portion of said inner conductor, a metallic shield surrounding at least a portion of the inner dielectric and an outer insulating jacket surrounding at least a portion of the metallic shield, a portion of the outer jacket of each of the cables being removed to expose an exposed portion of the metallic shield, comprising:

a connector including a dielectric housing;

a plurality of terminals mounted in the housing;

a conductive ground blade mounted in the housing and including at least a pair of spaced positioning arms for engaging the metallic shields of the pair of coaxial cables; and a partition integral with the housing extending between the positioning arms to separate the coaxial cables and maintain the metallic shields near the positioning arms.

15. The system of claim 14, including complementary interengaging abutment means between the housing and the ground blade to prevent the ground blade from backing out of the housing.

16. The system of claim 14 wherein said ground blade is generally planar and includes a slot, and said partition comprises a wall projecting through the slot and between the positioning arms.

17. The system of claim 14, including a pair of said positioning arms projecting from each opposite side of the ground blade, with a partition on the housing extending between each pair of arms to define four quadrants for accommodating four coaxial cables.

18. The system of claim 14 wherein said housing includes a front housing part mounting the terminals and the ground plate therein, and a rear housing part juxtaposed against the front housing part and including said partition.

19. The system of claim 14 wherein said positioning arms include an aperture therein.

* * * * *